US005292106A

United States Patent [19]

Li

[11] Patent Number: 5,292,106

[45] Date of Patent: Mar. 8, 1994

[54] STAPLE REMOVER

[76] Inventor: Tianhou Li, UNO Box 486, New Orleans, La. 70148

[21] Appl. No.: 38,876

[22] Filed: Mar. 29, 1993

[51] Int. Cl.[5] ..... B25C 11/00

[52] U.S. Cl. ..... 254/28

[58] Field of Search ..... 269/28, 18; 7/125, 165, 7/166

[56] References Cited

U.S. PATENT DOCUMENTS 3,143,800 8/1964 Vizzi ..... 254/28
3,630,486 12/1971 Foitle ..... 254/28
4,483,330 11/1984 Jacobsen et al. ..... 269/128
4,776,567 10/1988 Strickland ..... 254/28
4,834,352 5/1984 Thornton ..... 269/238
4,930,749 6/1990 Lawrence ..... 254/28
5,085,404 2/1992 Thieleke et al. ..... 254/28

*Primary Examiner*—Robert C. Watson
*Attorney, Agent, or Firm*—S. Michael Bender

[57] ABSTRACT

In a staple remover wherein a pair of pointed teeth engage with a second pair of teeth to remove a staple the improvement which comprises providing a pair of clamping plates at the opposite end thereof.

4 Claims, 3 Drawing Sheets

STAPLE REMOVER

BACKGROUND OF THE INVENTION

1. Field of the Invention

The present invention relates to staple removers having pivotally mounted jaws and more particularly pertains to such staple removers which may be used to remove staples when one end only of the staple is left after attempted removal.

2. Description of the Prior Art

The use of staple removers are known in the prior art. More specifically, such devices heretofore devised and utilized for the purpose of removing staples are known to consist basically of familiar, expected and obvious structural configurations, notwithstanding the myriad of designs encompassed by the crowded prior art which have been developed for the fulfillment of countless objectives and requirements. Illustrative of such devices are U.S. Pat. Nos. 4,205,823; 4,903,945; 4,921,216; 4,674,727.

Staple removers having pivotally mounted pointed teeth to engage with and remove staples occasionally will dislodge only one leg of a staple or perhaps breaks the staple in attempted removal. When this happens the device is usually useless in rectifying the situation.

In this respect, the staple remover according to the present invention substantially departs from the conventional concepts and designs of the prior art, and in so doing provides an apparatus primarily developed for the purpose of removing staples whether whole or broken.

With the present invention, clamp plates are provided on the opposite end of the staple remover so that if a staple is broken or only partially removed, the protruding staple or broken end thereof may be engaged by such plates and the removal completed.

Therefore, it can be appreciated that there exists a continuing need for new and improved staple removers. In this regard, the present invention substantially fulfills this need.

SUMMARY OF THE INVENTION

In view of the foregoing disadvantages inherent in the known types of staple removers now present in the prior art, the present invention provides an improved staple remover. As such, the general purpose of the present invention, which will be described subsequently in greater detail, is to provide a new and improved staple remover and method which has all the advantages of the prior art and none of the disadvantages.

To attain this, the present invention comprises providing the ends of a pivotal tooth staple remover with a clamping member adapted to engage with a single leg or a broken staple. The clamping member consists of a pair of opposed, preferably serrated, plates which are normally based in open position but when the stapler is operated swing into parallel relationship and grip tightly together.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved staple remover which has all the advantages of the prior art devices and none of the disadvantages.

It is another object of the present invention to provide a new and improved staple remover which may be easily and efficiently manufactured and marketed.

It is a further object of the present invention to provide a new and improved staple remover which is of a durable and reliable construction.

An even further object of the present invention is to provide a new and improved staple remover which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved staple remover which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
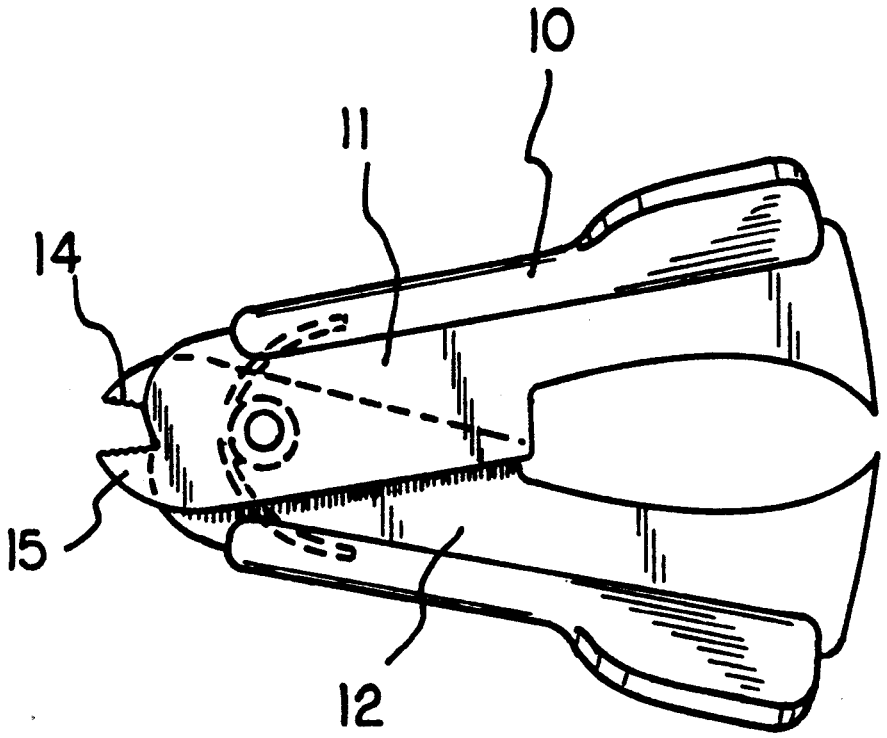
FIG. 1 is a side plan view of the device of the present invention.

With reference now to the drawings, and in particular to FIG. 1 thereof, a new and improved staple remover embodying the principles and concepts of the present invention and generally designated by the reference numeral 10 will be described.

More specifically, it will be noted that the staple remover 10 consists of a pair of pivotally connected spring-loaded members 11 and 12 having staple engaging members 13 at one end thereof. The opposite end of such members 11 and 12 have a pair of serrated clamp members 14 and 15 thereon.

Figure 2:
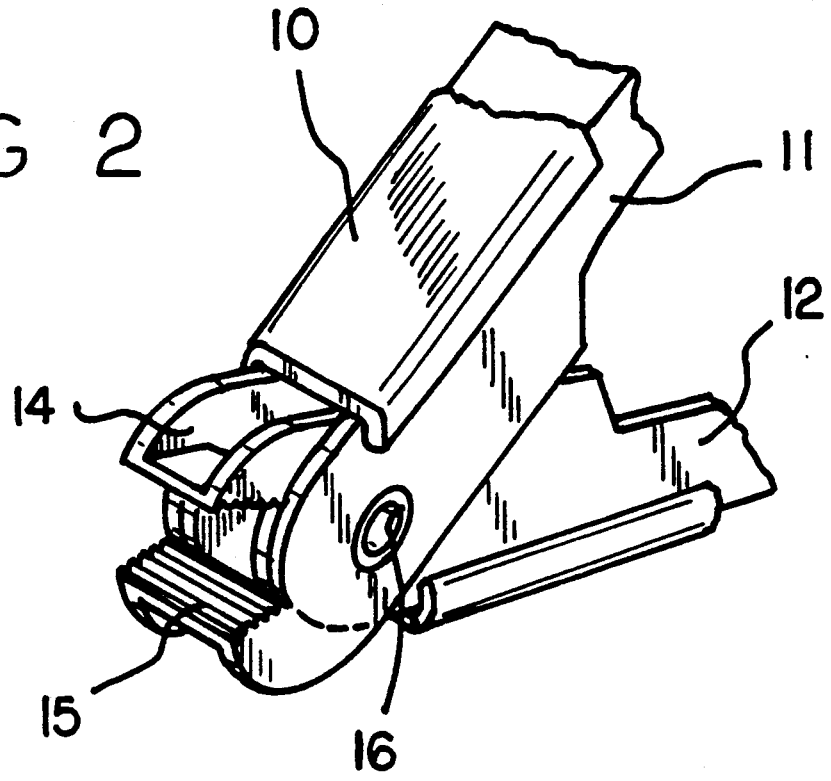
FIG. 2 is a partial perspective view of the device of FIG. 1 showing the clamping means of the present invention.

FIG. 2 illustrates the serrated clamp members 14 and 15 at the ends of members 12 and 11 respectively and shows the manner in which clamp member 14 extends inside member 11. The pivot pin is shown at 16.

Figure 3:
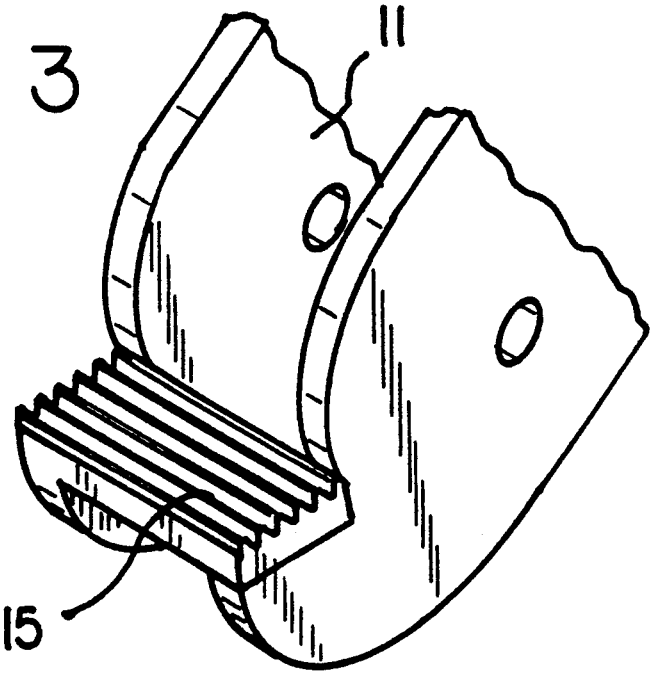
FIG. 3 is a partial perspective view of one portion of said clamping means.

FIG. 3 shows member 11 disassociated with the rest of the device 10 and illustrates the serrated plate 15 at the end of member 11.

Figure 4:
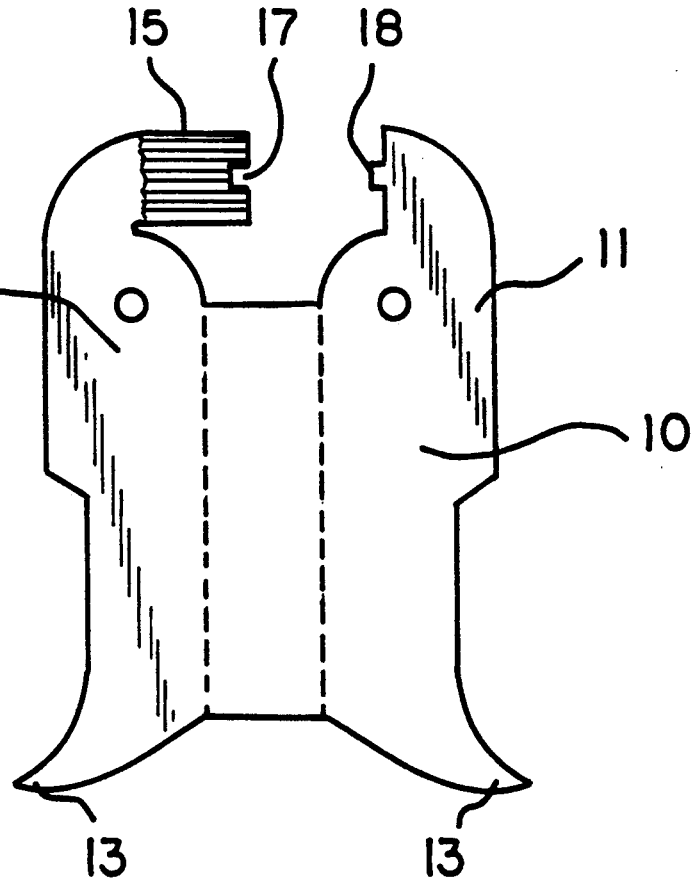
FIG. 4 is a plan view of a metal or plastic stamping preliminary to shaping into a component of the staple remover of the present invention.

FIG. 4 illustrates an economical method of forming the staple remover utilizing the illustrated metal or plastic stamping of one half of the staple remover 10 shown prior to folding as indicated on thee broken lines. The serrated plate 15 attached to one side plate 11 is herein shown with an aperture 17 in the face thereof adapted to engage and mate with a projection 18 on the other side plate 11 when the plates are folded into vertical relationship and the serrated plate is folded into horizontal relationship therewith. This will rigidify the structure and prevent moving of plate 15 when force is applied thereto.

Figure 5:
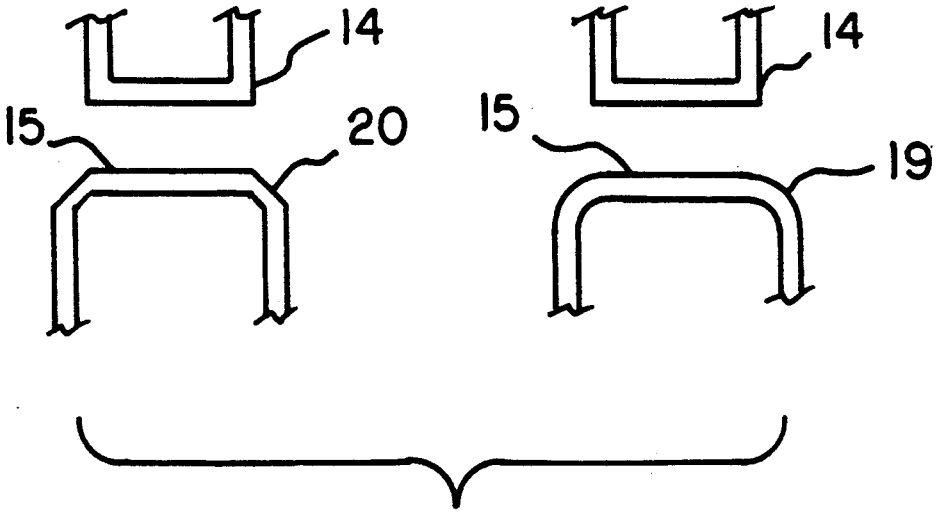
FIG. 5 shows end views of two variations on the shape of the lower clamp of said clamping means.

FIG. 5 illustrates in end view thereof that the lower plate 15 rather than being sqared off as shown in FIGS. 2 and 3 may have a carved (as at 19) or angular (as at 20) entry from the side wall 11 to the plate 15.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foreqoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new staple remover comprising:

a pair of pivotally-connected, spring-loaded arms;

staple-engaging and removing members present at one end of said arms;

and, clamping members present at the opposite end of said arms, wherein said clamping members comprise a pair of serrated plates adapted to engage one with the other, and further wherein each of said arms is formed of a pair of connected, parallel vertical side walls; one end of each of said serrated plates fastened to one of said pair of side walls and having an aperture in the other end of said serrated plates; and a projection secured to the other of said pair of side walls, said projection extending therefrom and operable to enter within and mate with said aperture in said serrated plates to secure said serrated plates between said side walls.

2. The new staple remover of claim 1, wherein said serrated plate is coupled to each of said side walls so as to define a carved entry from said side wall to said plate.

3. The new staple remover of claim 1, wherein said serrated plate is coupled to each of said side walls so as to define an angular entry from said side wall to said plate.

4. The new staple remover of claim 1, wherein said serrated plate is coupled to each of said side walls so as to define a right angle entry from said side wall to said plate.

* * * * *